US011249443B2

(12) United States Patent
Feyer et al.

(10) Patent No.: US 11,249,443 B2
(45) Date of Patent: Feb. 15, 2022

(54) CHRONOGRAPH REPEATER MECHANISM WITH SAFETY FUNCTION

(71) Applicant: OMEGA SA, Biel/Bienne (CH)

(72) Inventors: Julien Feyer, Vernier (CH); Cedric Reymond, Les Bioux (CH); Edmond Capt, Le Brassus (CH)

(73) Assignee: OMEGA SA, Biel/Bienne (CH)

( * ) Notice: Subject to any disclaimer, the term of this patent is extended or adjusted under 35 U.S.C. 154(b) by 685 days.

(21) Appl. No.: 16/164,868

(22) Filed: Oct. 19, 2018

(65) Prior Publication Data

US 2019/0187627 A1 Jun. 20, 2019

(30) Foreign Application Priority Data

Dec. 19, 2017 (EP) ..... 17208302

(51) Int. Cl.

| | |
|---|---|
| ***G04F 7/08*** | (2006.01) |
| ***G04B 21/00*** | (2006.01) |
| ***G04B 25/00*** | (2006.01) |

(52) U.S. Cl.

CPC ..... *G04F 7/089* (2013.01); *G04B 21/00* (2013.01); *G04B 25/00* (2013.01); *G04F 7/0842* (2013.01)

(58) Field of Classification Search

CPC ..... G04B 25/00; G04F 7/089; G04F 7/0482

See application file for complete search history.

(56) References Cited

U.S. PATENT DOCUMENTS

| | | | | |
|---|---|---|---|---|
| 67,704 A * | 8/1867 | Baker | ..... | G04F 7/0842 368/105 |
| 584,681 A * | 6/1897 | Fischer | ..... | G04B 21/12 368/268 |
| 641,478 A * | 1/1900 | Torres | ..... | G04B 21/12 368/268 |

(Continued)

FOREIGN PATENT DOCUMENTS

| | | |
|---|---|---|
| CH | 102 | 1/1889 |
| DE | 17 428 | 8/1881 |

(Continued)

OTHER PUBLICATIONS

European Search Report dated Jun. 20, 2018 in European Application 17208302.4 filed on Dec. 19, 2017 ( with English Translation of Categories of Cited Documents & Written Opinion).

*Primary Examiner* — Daniel P Wicklund

(74) *Attorney, Agent, or Firm* — Oblon, McClelland, Maier & Neustadt, L.L.P.

(57) ABSTRACT

Acoustic timepiece display mechanism with a chronograph repeater for the acoustic display, by a striking mechanism, of a duration measured by a chronograph mechanism, this striking mechanism including a winding lever for driving a rack to move a striking rack in order to read the magnitude concerned and to release a corresponding strike function, this acoustic display mechanism includes, between the mechanism controlling the chronograph mechanism and the winding lever, a mechanical connection arranged, depending on the position of a control cam of the chronograph mechanism indirectly defining a variable secondary direction of the winding lever, to isolate or not to isolate the winding lever from a winding pusher operated in a single pusher direction by a user to set off the acoustic display of the timed duration.

10 Claims, 2 Drawing Sheets

(56) References Cited

U.S. PATENT DOCUMENTS

| | | | | |
|---|---|---|---|---|
| 927,568 | A * | 7/1909 | Lux | G04B 21/022 368/270 |
| 959,165 | A * | 5/1910 | Reiner | G04B 21/12 368/268 |
| 10,095,185 | B2 * | 10/2018 | Behra | G04B 21/12 |
| 2004/0022133 | A1 * | 2/2004 | Schmiedchen | G04F 7/0871 368/110 |
| 2004/0090872 | A1 * | 5/2004 | Schmiedchen | G04F 7/0895 368/203 |
| 2005/0174888 | A1 * | 8/2005 | Forsey | G04F 7/0842 368/10 |
| 2008/0144448 | A1 * | 6/2008 | Goeller | G04B 21/12 368/190 |
| 2011/0110200 | A1 * | 5/2011 | Goeller | G04B 23/028 368/243 |
| 2016/0274548 | A1 | 9/2016 | Goldmann | |
| 2019/0033790 | A1 * | 1/2019 | Peter | G04B 23/12 |
| 2019/0155220 | A1 * | 5/2019 | Denden | G04B 21/10 |
| 2019/0179266 | A1 * | 6/2019 | Kissling | G04B 21/04 |
| 2019/0187617 | A1 * | 6/2019 | Peter | G04B 9/02 |
| 2019/0187621 | A1 * | 6/2019 | Feyer | G04B 21/04 |
| 2019/0187627 | A1 * | 6/2019 | Feyer | G04B 25/00 |

FOREIGN PATENT DOCUMENTS

| | | | | |
|---|---|---|---|---|
| EP | 1672442 | A1 * | 6/2006 | G04B 13/028 |
| EP | 2602675 | A1 * | 6/2013 | G04F 7/0814 |

* cited by examiner 100
56
62
61
57
60
54
541
542
53
58
55
500
33
32
D
51
393
A
390
39
B
50
52
C 542
541
53
500
33
31
32
1
D
51
392
390
39
B
A
C
50
52

100
57
54
60
540
542
541
53
56
59
55
58
500
31
32
1
394
391
51
393
392
390
D
5
33
39
B
A
C
50
52

CHRONOGRAPH REPEATER MECHANISM WITH SAFETY FUNCTION

CROSS-REFERENCE TO RELATED APPLICATION

This application claims priority of European Patent Application No. 17208302.4 filed on Dec. 19, 2017 the entire disclosure of which is incorporated herein by reference.

FIELD OF THE INVENTION

The invention concerns an acoustic timepiece display mechanism with a chronograph repeater for the acoustic display, via a striking mechanism, of a time duration measured by a chronograph mechanism, said chronograph mechanism comprising a control mechanism including a variable position control cam, and said striking mechanism comprising a winding pusher arranged to be operated in a single pusher direction by a user to set off the acoustic display of the measured time duration via said chronograph mechanism, said striking mechanism also comprising a winding lever arranged to drive a rack to move a striking rack to read the magnitude concerned and to release a corresponding strike function.

The invention also concerns a timepiece, especially a watch, including at least one such acoustic display mechanism.

The invention concerns the field of timepiece display mechanisms.

BACKGROUND OF THE INVENTION

Some timepiece displays are sometimes difficult to read, in particular when the timepiece is a watch of small dimensions, such as a ladies watch, or even a complicated watch, comprising a large number of displays, each then necessarily occupying a restricted surface area, or being superposed on other displays, which can make interpretation imprecise for the user, which is paradoxical given it is for a precision time measurement.

The reading of a display can also be hampered by low ambient lighting, such as during diving, or at certain times at night or dusk, or may conversely be hampered by interfering light that creates shadows making the indications illegible, or because of the user's visual impairment or particular conditions of employment, such as night flying or certain specific operations. This is why, moreover, horologists in the XVIII and XIX centuries developed striking, passing strike or repeater watches, or tactile watches providing tactile information.

European Patent No EP17206439.6 by the same Applicant discloses a chronograph mechanism connected to an external or internal striking mechanism for providing, particularly on demand, an acoustic display of a time duration measured by the chronograph mechanism; said mechanism being a chronograph repeater. When the chronograph mechanism is operating, the seconds and tens of seconds cams which are integral with the centre chronograph wheel rotate with the latter. If the chronograph repeater were started while the cams were turning, this would block the mechanism with a high risk of breakage. This is why it is necessary to ensure that the chronograph repeater cannot be set off while the chronograph mechanism is operating.

Swiss Patent Application No CH102A in the name of REBER discloses improvements to the design of watch repeater mechanisms:

- the lever actuating the repeater has its pivot point on the plate near the centre of the watch, and not on the rack pivot, to ensure a smoother movement of the repeater bolt;
- the two hammers pivot on the same pivot-shank, which saves considerable space; as a result for a repeater watch with a 19" calibre for example, it is possible to use the same trains as for an ordinary 19" watch, whereas in prior art repeaters the hammers took up so much space that ordinary 17" watch trains had to be used, which made the timepiece more expensive;
- instead of placing a pin, to which is hooked a rack carried by the quarter lever and activated by a small spring, on the striking rack, a rack is fixed to the striking rack, and the quarter lever includes a hook-arm formed such that a single strong spring, fixed to the plate and resting on the arm of the spring is used both for dropping the quarter lever onto the quarter snail cam and for hooking the hook to the quarter rack.

SUMMARY OF THE INVENTION

The invention proposes to provide operating safety for a chronograph repeater mechanism, combining a traditional visual display with an acoustic display, or replacing a traditional visual display with an acoustic display, to prevent the striking mechanism being released while the chronograph mechanism is operating, to measure a time duration, or during a reset operation.

To this end, the invention concerns an acoustic display timepiece mechanism according to claim 1.

The invention also concerns a timepiece, especially a watch, including at least one such chronograph repeater mechanism.

BRIEF DESCRIPTION OF THE DRAWINGS

Other features and advantages of the invention will appear from reading the following detailed description, with reference to the annexed drawings, in which:

FIGS. 1 and 2 correspond to the rest position of the chronograph mechanism, which is not activated, either for measuring a time duration or for a reset-to-zero operation.

FIG. 1 shows a winding pusher in a standby position, allowing a winding lever to be depressed.

FIG. 2 shows the fully depressed position of said same winding pusher, after said winding lever has been fully depressed, which causes a strike rack to pivot, initialising a cycle of striking the value measured by the chronograph mechanism.

FIG. 3 illustrates a measurement or reset-to-zero cycle being carried out in the chronograph mechanism, in a position wherein the safety mechanism according to the invention, which lies between the actual chronograph mechanism and the actual striking mechanism, prevents any action of the winding pusher on the winding lever, and thus prevents a striking cycle being started before the chronograph mechanism has completed the current cycle.

DETAILED DESCRIPTION OF PREFERRED EMBODIMENTS

Figures 1, 2, 3:
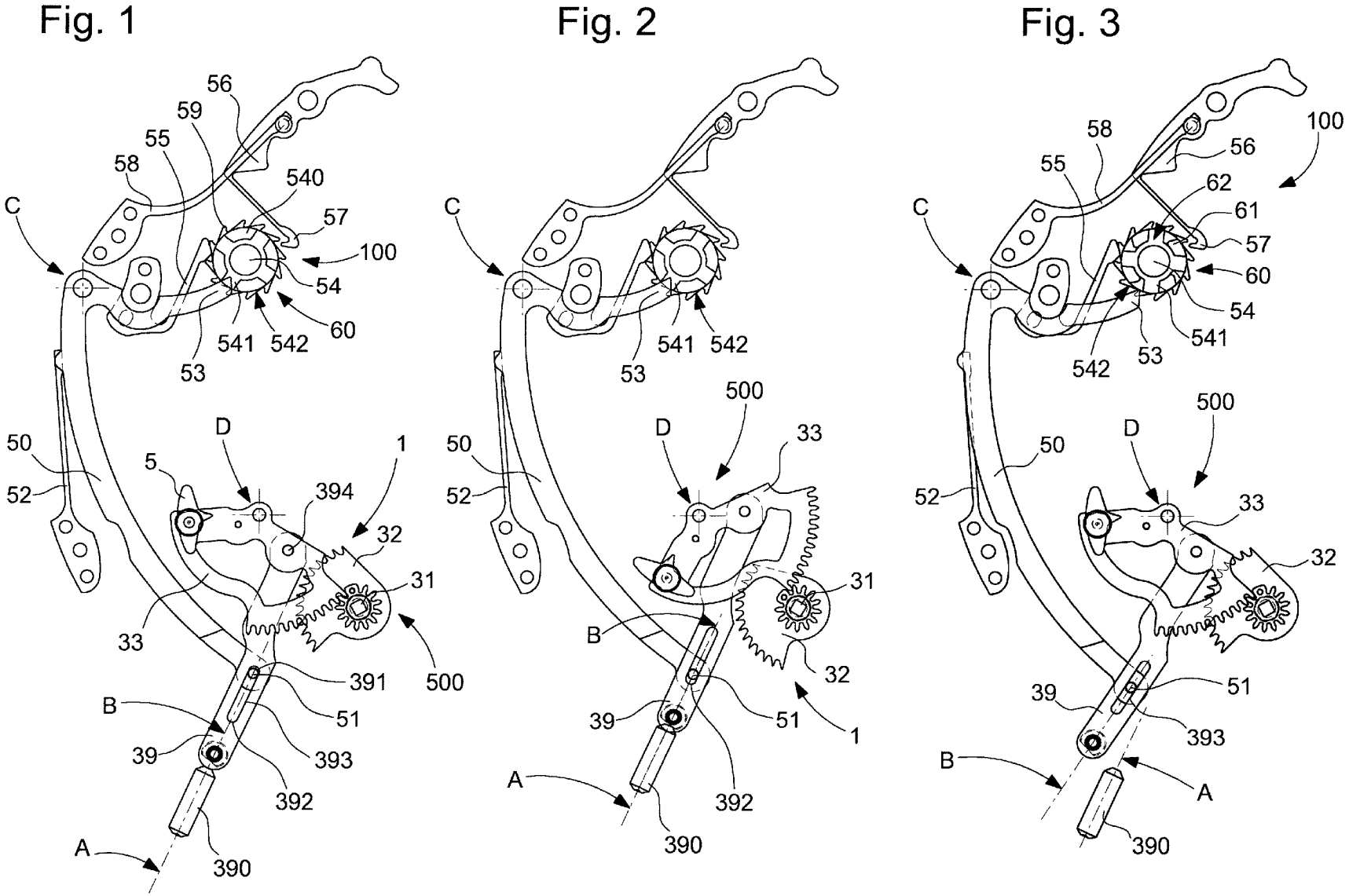
FIGS. 1 to 3 represent schematic plan views of a detail of a chronograph mechanism according to the invention, showing the interface between the mechanism controlling the chronograph mechanism, and the repeater control mechanism, illustrated in the particular and non-limiting case where the mechanism controlling the chronograph mechanism includes a column wheel.
Figure 5:
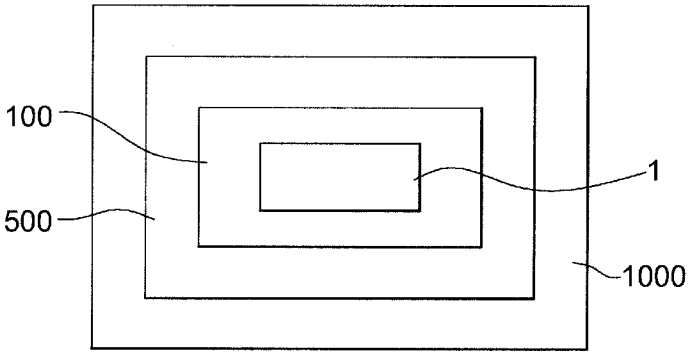
FIG. 5 is a block diagram representing a timepiece, especially a watch, wherein the striking mechanism is integrated in the display mechanism.
Figure 4:
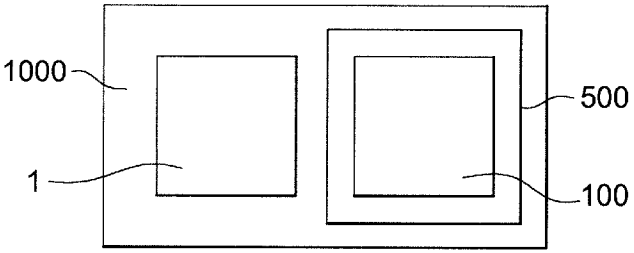
FIG. 4 is a block diagram representing a timepiece, especially a watch, wherein the striking mechanism is distinct from the display mechanism.

The invention concerns an acoustic timepiece display mechanism 500 for a timepiece 1000, especially a watch, or a sports timing device or otherwise, or a clock, or otherwise.

This timepiece 1000 includes, in a conventional manner, a movement, and energy storage means, for at least driving an oscillator, which are not described in detail here. This timepiece 1000 may also consist of a music box.

This display mechanism 500 includes at least one rotating display wheel set, connected in particular to a display member such as a hand, disc or suchlike, for the display of a magnitude other than the current time. A 'magnitude other than the current time' means a magnitude such as a time duration for a chronograph mechanism, or a total number of actions on a pusher for a sports referee device, or suchlike.

This display mechanism 500 is an acoustic display mechanism. To this end, the rotating display wheel set is integral, at least in rotation, with a display cam whose rim cooperates with the beak of a striking rack comprised in striking mechanism 1, which is integrated in or juxtaposed with display mechanism 500, for striking a numerical value characteristic of the measured magnitude.

The invention is more particularly described, in a non-limiting manner, for an on-demand display, by action of a user on a control member, such as winding pusher 390 as illustrated by the Figures, or a bolt, crown, bezel or any other actuator.

In the particular and non-limiting application illustrated by the Figures, this display mechanism 500 includes a chronograph mechanism 100 which includes at least a centre chronograph wheel for counting the seconds, and a minute-counter wheel for counting the minutes.

More particularly, this display mechanism 500 is a chronograph repeater mechanism, as described in European Patent Application EP17206439.6 by the same Applicant. This chronograph repeater mechanism is arranged to provide, after stopping at the end of a measurement of a timed duration made by chronograph mechanism 100, information relating to the timed duration, particularly in minutes and seconds, to striking mechanism 1 comprised in chronograph mechanism 100 or with which chronograph mechanism 100 is juxtaposed, in order to strike at least the minutes and the seconds of the timed duration. This striking mechanism 1 includes the required striking control components (particularly for the minutes and seconds, or tens of seconds or otherwise), for striking at least the units corresponding to the timed duration.

This acoustic timepiece display mechanism 500 with a chronograph repeater makes possible the acoustic display, by striking mechanism 1, of a timed duration via a chronograph mechanism 100.

According to the invention, striking mechanism 1 includes a winding lever 39, which is arranged to drive a rack 33 to move a striking rack to read the magnitude concerned and to release a corresponding strike function. This acoustic display mechanism 500 includes, between the mechanism controlling chronograph mechanism 100 and the winding lever 39, a mechanical connection arranged, depending on the position of a control cam 60, 54 of chronograph mechanism 100 indirectly defining a variable secondary direction B of winding lever 39, to isolate or not to isolate winding lever 39 from a winding pusher 390 actuated in a single pusher direction A by a user to set off the acoustic display of the timed duration.

More particularly, chronograph mechanism 100 includes a control mechanism, which includes a control cam 60, such as a column wheel 54, or control cam, or otherwise. Chronograph mechanism 100 includes at least one rotating display wheel set, such as the seconds wheel set or the minute wheel set, which is integral, at least in rotation, with a corresponding display cam, whose rim cooperates with the beak of a corresponding striking rack, comprised in striking mechanism 1, to strike a numerical value characteristic of a timed duration measured by chronograph mechanism 100.

Striking mechanism 1 includes a winding lever 39, which is arranged to start the reading of this timed duration on each display cam. More particularly but in a non-limiting manner, this winding lever 39 is arranged to drive a rack 33 against elastic return means forming drive means for striking mechanism 1, in order to move a striking rack for each display cam to read the magnitude concerned, for example a minute rack on a minute snail cam, a seconds rack on a seconds snail cam, a tens-of-seconds rack on a tens-of-seconds cam or suchlike.

The mechanical isolation connection is arranged, depending on the position of a control cam 60 or 54, comprised in chronograph mechanism 100, to isolate or not to isolate winding lever 39 from winding pusher 390.

More particularly, this mechanical isolation connection includes at least a safety lever 50, resting on control cam 60 or 54, and resting, or preferably articulated, as in the embodiment illustrated by the Figures, on or with winding lever 39.

Chronograph mechanism 100 includes, in a conventional manner, user-accessible external control means, such as a start/stop pusher, reset pusher, or similar, and particularly as described in the collective work 'Théorie d'horlogerie' by Messrs Reymondin, Monnier, Jeanneret, Peleratti, edited by the FET (Federation of Technical Schools), Switzerland, in chapter 11. For the start/stop function, these external control means generally drive a winding lever 56, which pushes or pulls a control cam 60, especially a pivoting cam, such as a column wheel 54, or a cam comprising an upper cam and a lower cam, or otherwise.

The invention is applicable both to a chronograph with a single pusher as illustrated in the Figures, used for the START, STOP and RESET functions, and to a chronograph mechanism with two pushers, one for the start/stop, and the other for the reset function, by the same logic, which consists, when either one of two pushers is actuated for the start or reset functions, in moving an isolating mechanism, comprising a safety lever as set out below, arranged to render ineffective any manual actuation of the striking mechanism while one of the START or RESET functions of the chronograph mechanism is active.

This control cam 60 includes a series of protruding portions 61 and recessed portions 62, either axially or radially, such that a safety lever 50, which is held resting on said control cam 60 by safety elastic return means 52, occupies different angular positions, depending on whether a beak 53, comprised in safety lever 50, cooperates with a protruding portion 61 or a recessed portion 62.

In a particular and non-limiting application illustrated by the Figures, chronograph mechanism 100 includes a column wheel 54, with a ratchet 59 arranged to be pulled by the hook 57 of a main operating lever 56 returnable by a lever spring 58. This column wheel 54 includes columns 540, forming protruding portions 61 and having a substantially cylindrical rim 542. These columns 540 are separated by notches 541 forming recessed portions 62. This column wheel is held in position in a conventional manner by a jumper spring 55 or similar.

Safety lever 50 is thus controlled by chronograph control cam 60, particularly column wheel 54, and can position winding lever 39 of the chronograph repeater mechanism in two positions, via a pin 51 integral with safety lever 50, and which acts as an articulation in an oblong opening 393 of winding lever 39.

Winding lever 39 is subjected here to longitudinal pressure from a winding pusher 390, which is movable in a single pusher direction A.

Oblong opening 393 defines a secondary direction B, which is not fixed since it depends on the angular position of safety lever 50, which pivots about its lever axis C.

It is understood that the mechanical isolation connection allows winding lever 39 to be operated by winding pusher 390 when secondary direction B coincides with pusher direction A and prevents said operation when secondary direction B and pusher direction A diverge.

FIG. 1 illustrates a position in which beak 53 of safety lever 50 is engaged in a notch 541, between two columns 542, which corresponds to the stop position of the chronograph (STOP). In this position, safety lever 50 is in a 'low' position, where pusher direction A of winding pusher 390 and secondary direction B of winding lever 39 are aligned: winding lever 39 is facing winding pusher 390. Safety lever pin 51 is at a first end 391 of oblong opening 393, the entire length of which is available. The user can therefore depress winding pusher 90, and consequently push winding lever 39, to start the chronograph repeater.

FIG. 2 illustrates the fully depressed position by the user, still in the STOP position of the chronograph. Safety lever pin 51 has moved to the second end 392 of oblong opening 393, opposite to first end 391. The pushing action of winding lever 39 pivots rack 33 about its axis D, through the action of pin 394 carried by winding lever 39, and starts the acoustic reading of the value of the duration measured by chronograph mechanism 100. Rack 33 meshes here, in a non-limiting manner, with a rack pinion 31 integral in rotation with a minute-ratchet 32.

FIG. 3 illustrates the case where chronograph mechanism 100 is operating and in the process of measuring a time duration (START), or of performing a reset operation (RESET) in the particular case of the Figure. Beak 53 of safety lever 50 is resting in this case on edge 542 of a column 540, which brings safety lever 50 into a 'high' angular position, different from the 'low' position that it occupies in FIGS. 1 and 2, and which results in a lack of alignment between pusher direction A of winding pusher 390 and secondary direction B of winding lever 39. Consequently, if the user depresses winding pusher 390, nothing can happen, since winding pusher 390 operates in thin air, without encountering any moving parts to be operated on its travel.

It is understood that this configuration avoids any risk of stopping or breaking the movement: the user can only start the chronograph repeater when he is entitled to do so, i.e. when chronograph mechanism 100 is inoperative.

The invention applies in a similar manner, in a non-illustrated variant, to a cam control mechanism. The safety lever must then be in a 'high' position for the START and RESET functions and in a 'low' position for the STOP function. It is possible to add a wheel set comprising a cam, or to machine a cam shape into an unused part of the cam, particularly on the rim of the lower cam, or by placing on the lower cam a cam or a toothing that replicates the functions of the columns and recesses between the columns, which are shown here in the example with a column wheel illustrated by the Figures.

The invention can implement a more complex striking mechanism than those shown in the aforementioned reference work, particularly with several striking functions or melodies as in the patent applications in the name of BLANCPAIN: traditional strike function or playing a melody, striking mechanism with several stages with different rack components.

The invention also concerns a timepiece 1000, particularly a watch, including such a display mechanism 500.

In one embodiment, striking mechanism 1 is distinct from display mechanism 500.

In another embodiment, striking mechanism 1 is integrated in said display mechanism 500.

Although the acoustic display mechanism described above is designed to be combined with a conventional visual display, it can also replace the latter.

The invention allows a useful safety function to be added to a chronograph repeater display mechanism, which combines a chronograph mechanism and a striking mechanism, which are known to be the most complex and delicate timepiece mechanisms, and which must be protected from any mishandling.

The invention claimed is:

1. An acoustic timepiece display mechanism, comprising:
a striking mechanism;
a chronograph mechanism; and
a chronograph repeater for an acoustic display, by the striking mechanism, of a duration measured by the chronograph mechanism,
wherein said chronograph mechanism includes a control mechanism having a control cam whose position is variable,
wherein said striking mechanism includes a winding pusher arranged to be operated in a single pusher direction by a user to set off the acoustic display of the duration timed by said chronograph mechanism, said striking mechanism also includes a winding lever arranged to drive a rack to move a striking rack to read the duration measured by the chronograph mechanism and to release a corresponding strike function,
wherein said winding lever is arranged in a variable secondary direction, and
wherein the acoustic timepiece display mechanism includes, between said control mechanism and said winding lever, a mechanical connection, arranged, depending on the position of said control cam, to isolate or not to isolate said winding lever from said winding pusher.

2. The acoustic display mechanism according to claim 1, wherein said striking mechanism includes at least one said striking rack formed by a minute rack arranged to cooperate with a minute snail cam and/or by a tens-of-seconds rack arranged to cooperate with a tens-of-seconds cam, and/or by a seconds rack arranged to cooperate with a seconds snail cam,
wherein said chronograph mechanism includes at least one rotating display wheel set integral, at least in rotation, with a specific display cam arranged to cooperate with said at least one said striking rack, and whose rim is arranged to cooperate with the beak of said at least one said striking rack, and wherein said winding lever is arranged to start the reading of said timed duration on each said specific display cam corresponding to said at least one said striking rack, and to drive said rack against elastic return means forming drive means for said striking mechanism to move each said at least one said striking rack for each said corresponding display cam in order to read the magnitude concerned.

3. The acoustic display mechanism according to claim 1, wherein said mechanical isolation connection includes at least one safety lever, resting on said control cam, and resting on or articulated with said winding lever.

4. The acoustic display mechanism according to claim 3, wherein said control cam includes a series of protruding portions and recessed portions, either axially or radially, such that said safety lever, which is held resting on said control cam by safety elastic return means, occupies different angular positions, depending on whether a beak, comprised in said safety lever, cooperates with a said protruding portion or a said recessed portion.

5. The acoustic display mechanism according to claim 3, wherein said safety lever, arranged to be controlled by said control cam is arranged to position said winding lever of the chronograph repeater mechanism in two positions, via a pin integral with said safety lever, and which acts as an articulation in an oblong opening comprised in said winding lever, which opening defines said variable secondary direction, which is not fixed since it depends on the angular position of said safety lever, which is pivotally mounted about a lever axis.

6. The acoustic display mechanism according to claim 5, wherein said mechanical isolation connection allows said winding lever to be operated by said winding pusher when said secondary direction coincides with said pusher direction, and prevents said operation when said secondary direction and said pusher direction diverge.

7. A timepiece including an acoustic display mechanism according to claim 1.

8. The timepiece according to claim 7, wherein said striking mechanism is distinct from said acoustic display mechanism.

9. The timepiece according to claim 7, wherein said striking mechanism is integrated in said acoustic display mechanism.

10. The timepiece according to claim 7, wherein said timepiece is a watch.

* * * * *